US006145588A

United States Patent [19]

Martin et al.

[11] Patent Number: 6,145,588

[45] Date of Patent: Nov. 14, 2000

[54] AIR-TO-AIR HEAT AND MOISTURE EXCHANGER INCORPORATING A COMPOSITE MATERIAL FOR SEPARATING MOISTURE FROM AIR TECHNICAL FIELD

[75] Inventors: Gerald L. Martin, Edina; Jon E. Johnson, Plymouth; Ephraim E. M. Sparrow, St. Paul, all of Minn.

[73] Assignee: XeteX, Inc., Minneapolis, Minn.

[21] Appl. No.: 09/128,606

[22] Filed: Aug. 3, 1998

[51] Int. Cl.[7] ..... F28F 3/00

[52] U.S. Cl. ..... 165/166; 165/DIG. 382; 165/133; 165/DIG. 373

[58] Field of Search ..... 165/54, 166, DIG. 387, 165/DIG. 373, 165, 133

[56] References Cited

U.S. PATENT DOCUMENTS

| | | | |
|---|---|---|---|
| 2,478,617 | 8/1949 | Anderegg | 62/140 |
| 2,986,379 | 5/1961 | Kramig, Jr. | 261/28 |
| 3,065,956 | 11/1962 | Meek | 261/29 |
| 3,398,510 | 8/1968 | Pennington | 55/163 |
| 3,666,007 | 5/1972 | Yoshino et al. | 165/166 |
| 3,847,211 | 11/1974 | Fischel et al. | 165/166 |
| 3,925,021 | 12/1975 | Yoshino et al. | 165/166 |
| 4,041,592 | 8/1977 | Kelm | 165/166 |
| 4,051,898 | 10/1977 | Yoshino et al. | 165/166 |
| 4,248,297 | 2/1981 | Pei | 165/166 |
| 4,259,183 | 3/1981 | Cadotte | 210/654 |
| 4,277,344 | 7/1981 | Cadotte | 210/654 |
| 4,449,992 | 5/1984 | Yamada et al. | 55/158 |
| 4,539,256 | 9/1985 | Shipman | 428/315.5 |
| 4,550,773 | 11/1985 | Martin | 165/54 |
| 4,616,695 | 10/1986 | Takahashi et al. | 165/166 |
| 4,726,989 | 2/1988 | Mrozinski | 428/315.5 |
| 4,781,733 | 11/1988 | Babcock et al. | 55/16 |
| 4,858,685 | 8/1989 | Szücs et al. | 165/166 |
| 4,963,165 | 10/1990 | Blume et al. | 55/16 |
| 5,033,537 | 7/1991 | Atkin et al. | 165/32 |
| 5,069,272 | 12/1991 | Chagnot | 165/8 |
| 5,088,552 | 2/1992 | Raunio | 165/166 |
| 5,183,098 | 2/1993 | Chagnot | 165/8 |
| 5,183,106 | 2/1993 | Stancliffe et al. | 165/166 |
| 5,238,052 | 8/1993 | Chagnot | 165/8 |
| 5,322,117 | 6/1994 | Guetersloh et al. | 165/166 |
| 5,775,410 | 7/1998 | Ramm-Schmidt et al. | 165/110 |
| 5,785,117 | 7/1998 | Grinbergs | 165/166 |
| 5,832,993 | 11/1998 | Ohata et al. | 165/166 |
| 5,868,199 | 2/1999 | Lavin | 165/166 |

FOREIGN PATENT DOCUMENTS 60-205163 A1 10/1985 Japan .

OTHER PUBLICATIONS

Hernandez et al., *Journal of Membrane Science*, "Pore Size Distribution in Microporous Membranes.", vol. 112, 1996, pp. 1–12.

(List continued on next page.)

*Primary Examiner*—Ira S. Lazarus
*Assistant Examiner*—Terrell McKinnon
*Attorney, Agent, or Firm*—Crompton, Seager & Tufte, LLC

[57] ABSTRACT

An improved air-to-air, heat-and-moisture exchanger is described which facilitates the simultaneous transfer of both heat and water vapor between two streams of air while greatly inhibiting the transfer of pollutant gases. A rigid encasement supports a stack of flat, thin-film composite membranes that are held in parallel, spaced-apart relation, thereby forming a box-shaped exchanger. The membranes are synthesized by interfacial polymerization, a process whereby a thin, non-porous film may be uniformly deposited onto a porous substrate material. The thin film is hydrophilic so as to provide high water vapor flux together with excellent selectivity against the transfer of other gases and vapors. The substrate provides mechanical support. Each of the parallel sheets of composite membrane in the stack separates two continuously flowing streams of air, one comprised of the air being exhausted from a building and the other comprised of the fresh air brought in to replace the exhausted air, thereby providing simultaneous heat transfer and moisture transfer between the streams while selectively restricting the transfer of the pollutant gases found in the exhaust air.

18 Claims, 1 Drawing Sheet

OTHER PUBLICATIONS

ASTM Designation: F–316–86, "Standard Test Methods for Pore Size Characteristics of Membrane Filters by Bubble Point and Mean Flow Pore Test".

Johnston, "Pore Size in Filter Media", Prepared for the American Filtration Society Meeting on The Pore, Hershey, PA, May 1991, pp. 1–12.

Cadotte, J.E., "Thin–Film Composite Reverse–Osmosis Membranes: Origin, Development, and Recent Advances," *Synthetic Membranes*, vol. 1, ACS Symposium Series 153 (1981).

Fisk et al., "Formaldehyde and Tracer Gas Transfer Between Airstreams in Enthalpy—Type Air–to–Air Heat Exchangers," *ASHRAE Transactions*, v. 91, p. 173 (1985).

Mizutani, et al., "Microporous Polypropylene Sheets", *Ind. Eng. Chem. Res.*, vol. 32, pp. 221–227, 1993.

Yasuda et al., "Pore Size of Microporous Polymer Membranes", *Journal of Applied Polymer Science*, vol. 18, pp. 805–819, 1974.

Cabasso et al., "Porosity and Pore Size Determination in Polysulfone Hollow Fibers", *Journal of Applied Polymer Science*, vol. 21, pp. 1853–1900, 1977.

Wang et al., "Hollow Fiber Air Drying," *J. Of Membrane Sci*, v. 72, pp. 231–244 (1992).

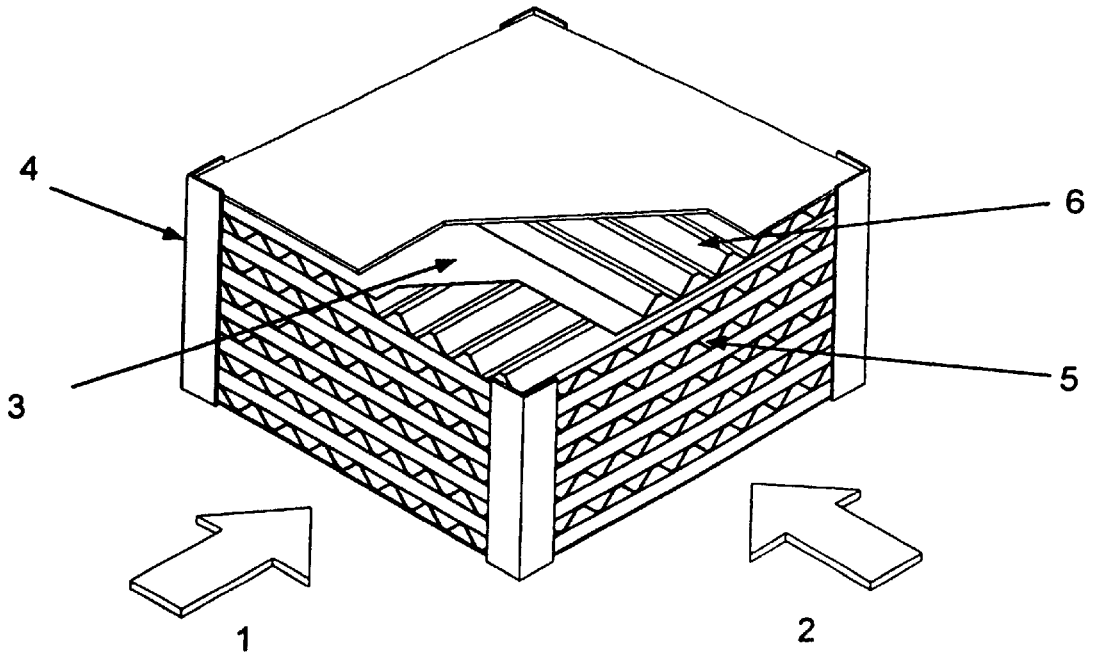
4
6
3
5
1
2

AIR-TO-AIR HEAT AND MOISTURE EXCHANGER INCORPORATING A COMPOSITE MATERIAL FOR SEPARATING MOISTURE FROM AIR TECHNICAL FIELD

TECHNICAL FIELD

The present invention relates generally to the heating or cooling of ventilation air; to the water-vapor content of ventilation air, to the recovery of energy from air being exhausted from buildings; and specifically to an air-to-air, heat-and-moisture exchanger made from a thin-film composite membrane which provides for the simultaneous transfer of both heat and water vapor between the ventilation air being exhausted from a building and the incoming fresh ventilation air.

BACKGROUND OF THE INVENTION

Indoor spaces are commonly ventilated by means of the controlled introduction of outdoor air. When outdoor air must be conditioned prior to its introduction into interior spaces to meet human comfort or industrial standards, the amount of energy required for ventilation increases sharply. To reduce energy usage, air-to-air heat exchangers are frequently employed to recover energy from building exhaust air. In winter, heat is transferred from the warm exhaust air to the cold incoming air. In summer, heat is transferred from the incoming fresh air to the relatively cooler exhaust drawn from air-conditioned spaces. Air to air heat exchangers are also applied to transfer energy in recirculation of building air, drying air or gas processes and other heat transfer processes. Heat exchangers that operate in this way are commonly built from an assemblage of parallel plates of aluminum or plastic, and hence are referred to as parallel-plate heat exchangers (see U.S. Pat. Nos. 4,051,898; 4,874,042; 5,033,537; 4,006,776; 4,858,685). When the two air streams pass in opposite directions, the exchanger is said to be counter-flow. More commonly, the two air streams pass at right angles to one another in adjacent flow passages that are separated by the plates, and the exchanger is said to be crossflow. The plates allow a high degree of thermal contact between the two air streams, but prevent direct mixing.

It is advantageous, but considerably more difficult, to transfer water vapor between the streams in addition to heat, especially when the transfer of gaseous pollutants between the air streams is unacceptable. In winter, valuable humidity can be recovered from the exhaust and transferred to the dry, fresh air. In summer, the relative humidity of the incoming fresh incoming air can be reduced if moisture is transferred from it to the relatively drier exhaust air.

Devices are currently available for transferring both heat and water vapor. They are classified either as regenerators or as porous-plate, air-to-air recouperators. Regenerators are designed to enable two different air streams to pass successively over a single heat and mass transfer medium. The medium is often a rotating disk, known as a heat wheel, which continuously rotates through two side-by-side but separate air streams. Heat and moisture are absorbed by the rotating medium as it passes through the hotter or more humid air stream and are rejected from that same medium as the heat wheel rotates into the cooler or less humid air stream (see U.S. Pat. Nos. 3,065,956; 3,398,510; 5,869,272; and 5,183,098). Heat wheels incorporate many moving parts that are prone to wear and failure. Furthermore, air leakage between the streams is inevitable. Pollutant gases entrained in one stream leak through the seals separating the air streams as the medium rotates. The amount of pollutant leakage depends on the construction of the mechanical air seals and upon the magnitude and direction of the pressure difference between the air streams.

Porous-plate, air-to-air recouperators are intended to transfer both heat and water vapor. They contain no moving parts, and are comprised of a series of parallel plates. The porous plates used in currently available recouperators are made from treated paper rather than aluminum or plastic (see U.S. Pat. Nos. 2,478,617; 2,986,379; 3,166,122; 3,666,007; 4,550,773; and 4,051,898; and Japanese Pat. Doc. 60-205193). In general, current porousplate recouperators leak air and pollutants between the air streams in addition to the moisture transfer.

U.S. Pat. No. 4,051,898 (Yoshino, et al.) describes a porous-plate exchanger made from paper treated with a moisture-absorbing compound such as polyvinyl alcohol. A commercially available, Yoshino-patented exchanger was evaluated by Fisk, et al. (Fisk, W. J., B. S. Pedersen, D. Hekmat, R. E. Chant, H. Kaboli, "Formaldehyde and Tracer Gas Transfer between Airstreams in Enthalpy-Type Air-to-Air Heat Exchangers", *ASHRAE Transactions,* 91, 173 (1985)) who determined that the Yoshino exchanger possessed an effectiveness for water vapor transfer of 28%. The effectiveness, E, compares the actual transfer to the maximum possible transfer between the streams under ideal conditions. An effectiveness for water vapor transfer of at least 25% is preferred.

Fisk, et al. (1985) also measured the effectiveness of the same porous-plate exchanger for the transfer of three representative pollutant gases. The measured values were 10.3% for formaldehyde, 7.3% for propane, and 6% for sulfur hexaflouride. These rates of pollutant transfer are considered too high for air quality sensitive applications, and pollutant transfer concerns have hindered the acceptance of porous-plate exchangers.

Another version of the porous-plate exchanger, described in Japanese Pat. Doc. 60-205193 by Takahashi, et al., incorporated a microporous polymer film saturated or coated with a moisture-absorbing substance. That substance was a combination of a hydrophilic polymer, such as polyvinyl alcohol, and a hygroscopic, inorganic salt, such as lithium chloride. Liquid water, appearing within the pores as a result of the hydration of the inorganic salt, served to plug the pores, preventing air transfer through the film. A range of pore diameter was chosen, 0.1 to 10 microns, which allowed liquid-phase mass transfer within the pores but which prevented blow-out of the liquid by the air pressure differential imposed by the ventilation system. The coated-film exchanger had a mean effectiveness for water vapor transfer of 63%. Its effectiveness for carbon dioxide transfer, measured at 3%, is still too high whenever air quality is a priority.

For the purpose of comparing mass exchanger devices, the selectivity, S, of an exchanger for water vapor with respect to a pollutant gas may be calculated from a ratio of the effectiveness.

$$S=\epsilon(\text{water vapor})/\epsilon(\text{pollutant}) \qquad \text{Equation 1}$$

From the results of Fisk, et al. (1985), the selectivity of the paper exchanger for water vapor relative to formaldehyde was 2.7. For water vapor relative to propane the selectivity was 3.8, and for water vapor relative to sulfur hexaflouride, 4.7. The coated-film exchanger of Takahashi was more selective, providing S=21 for water relative to carbon dioxide.

In addition to their low-to-moderate selectivities, current models of the porous-plate exchanger have other drawbacks. In terms of mechanical properties, the structural integrity of the treated paper exchanger is compromised when the paper becomes wet as a result of condensation. Condensation is likely to occur in porous-plate exchangers during cold weather operation. The paper absorbs moisture, swells, and weakens the exchanger structure. When air at temperatures below 32° F. is present, the moisture-laden paper freezes and cracks. The air-separating structure is broken and is incapable of preventing excessive gaseous pollutant leakage.

Coated films incorporating water-soluble compounds like the barrier proposed by Takahashi for use in air to air heat -moisture exchangers is impractical. Under cold-weather, condensing conditions, any liquid water condensate contacting the salt-bearing liquid within the pores leaches the salt from the film. With repeated exposure to condensate, the accessible salt is stripped away, leaving behind air-filled pores which are less effective at blocking the transfer of pollutant gases.

Thin-film composite membranes have been used in the fields of reverse osmosis and gas separations but not heretofore for air-to-air heat and moisture exchangers. Reverse osmosis and gas separation applications are characterized by very large cross-membrane pressure differences (up to 1000 psi) and by relatively low rates of fluid flow, while an air-to-air heat and moisture exchanger application is typified by cross-stream pressure differences of 1 inch of water (0.036 psi) and high rates of fluid flow (hundreds of cubic feet per minute).

A critical process in the development of thin-film composite membranes is interfacial polymerization (Cadotte et al., U.S. Pat. No. 4,259,183 and 4,277,344). The disclosures of Cadotte et al. are incorporated herein by reference. During interfacial polymerization, a porous supporting material is first saturated with a monomer-bearing solution. A second solution, immiscible with the first, is then contacted with one or both surfaces of the porous support. The second solution contains a monomer which reacts rapidly with the first monomer to produce, via a condensation reaction, a polymer that is often covalently bonded to the porous support. The formation of the polymer film at the interface of the two solutions separates the reagents, limiting the forward progress of the reaction. The self-limiting nature of the reaction results in a non-porous film that is very thin and yet continuous (see Cadotte, et al., "Thin-Film Composite Reverse-Osmosis Membranes: Origin, Development, and Recent Advances," in Vol. I of Synthetic Membranes, ACS Symposium Series 153 (1981)).

The application of interfacially polymerized membranes to gas separations is exemplified by the oxygen/nitrogen system (U.S. Pat. No. 4,493,714) and the oxygen/nitrogen/carbon-dioxide/hydrogen system (U.S. Pat. No. 4,963,165). For the drying of compressed air, a thin-film composite membrane in the form of a hollow fiber was developed. A bundle of such hollow fibers was fed with a high pressure mixture of the gases to be separated [Wang et al., "Hollow Fiber Air Drying," J. of Membrane ci., v. 72, pp.231–244, 1992]. Many interfacially polymerized membranes developed for reverse osmosis applications incorporate condensation polymers which are highly hydrophilic and potentially suitable for separations involving water vapor (U.S. Pat. Nos. 4,876,009, 5,593,588, 4,259,183, and 4,277,344). All of these applications are at high cross-membrane pressure drops and/or at low rates of fluid flow.

SUMMARY OF THE INVENTION

The invention described herein is an air-to-air heat and moisture exchanger which has the unique capability of efficiently passing heat and moisture across its walls while severely restricting the cross-wall passage of other gases, particularly, gaseous pollutants. This performance is achieved by the use of a special composite membrane. The membrane material in sheet form comprises the walls of the heat and moisture exchanger. Typically, but not exclusively, the membrane sheets are deployed to create parallel flow channels in a configuration in which every other flow channel conveys one of the participating air streams and the alternate flow channels convey the other air stream. The cross-stream pressure differences in this type of air-to-air heat and moisture exchanger are small, typically on the order of one inch of water. The corresponding cross-stream forces are very small and are balanced by a simple support structure. The small cross-stream pressure differences that are inherent in air-to-air heat and moisture exchangers preclude the use in this application of composite membranes which are the state-of-the-art for virtually all gas separation processes. Those separation processes require very high cross membrane pressure differences (perhaps, 1,000 psi) for their successful implementation.

Presently existing membranes suitable for use at the cross-membrane pressure differences of air-to-air heat and moisture exchangers are sufficient for moisture transfer, but do not adequately inhibit the transfer of other gases, including gaseous pollutants. This insufficiency motivated the present invention.

The membrane utilized in the present invention is a composite membrane, which includes a porous substrate and a layer formed on it by interfacial polymerization of a deposited hydrophilic polymeric material. A defect-sealing coat of a polymeric material may be overlaid on the hydrophilic polymeric material. The hydrophilic polymeric material is generally insoluble in water. It may be the condensation reaction product of a polyfunctional amine with a polyfunctional acyl halide. The hydrophilic polymeric material may be selected from the group consisting of polyamides, polyureas, polysiloxanes, polyesters, polycarbonates, polyurethanes, polysulfonamides, and the copolymers of these. The porous substrate may be made from a polymeric material selected from the group consisting of: cellulose nitrate/acetate, polyvinylidene, fluoride, polypropylene, polyester, polytetrafluoroethylene, nylon, polyethersulfone, polyamide, cellulose and polyethylene.

BRIEF DESCRIPTION OF THE DRAWING

The FIGURE is a representation of a preferred embodiment of the invention comprising a parallel-plate heat-and-moisture exchanger made from parallel sheets of thin-film composite membrane. Proper sheet spacing and airflow alignment is maintained by means of inserted corrugated layers between the membrane sheets.

DETAILED DESCRIPTION OF THE INVENTION

The FIGURE depicts a preferred embodiment of the invention. Two ventilation air streams are represented by broad arrows, with arrow 1 being the exhaust air stream and arrow 2 being a fresh air stream. These air streams pass at 90 degrees to one another, i.e., in cross-flow, with each stream confined to one-half of the total number of channels on an alternating basis, as shown. The thin-film composite membrane, 3, is a flat sheet that separates the respective air streams. Air channels, 5, are maintained by a series of corrugated or folded layers, 6, between the membrane sheets and are made from materials such as, but not limited to, rigid plastics or aluminum. The stack is frequently encased within a rigid frame, 4.

In another preferred embodiment, the corrugated layers are replaced by spacers such as ridges or protuberances which are molded extensions of the membranes themselves. Alternatively, the corrugations and spacers may be omitted entirely from either the fresh or exhaust air stream.

In another preferred embodiment, the two air streams pass at 180 degrees to one another, i.e., in counterflow.

Any acceptable method of assembly may be used. The membrane and separating layers may be glued, solvent welded, thermally bonded, or ultrasonically welded. The frame may be made from metal, such as extruded aluminum, or from rigid plastic.

Means for passing the first air stream or exhaust air stream 1 and the second air stream or fresh air stream 2 through alternating flow areas are provided. For the preferred cross-flow exchanger, the means includes duct work which carries the respective air streams to and away from the exchanger sealably connected to the sides thereof. In an alternative counter flow exchanger, duct work incorporating a distributor to alternating flow areas is included.

The two air streams entering the exchanger generally have different temperatures and different water vapor partial pressures. Heat is transferred through the separating membranes from the high temperature stream to the low temperature stream. In the present invention, water vapor is simultaneously transferred from the stream with the higher water vapor partial pressure to the stream with the lower water vapor partial pressure. Both air streams are at near-atmospheric pressure, such that the total pressure difference between the two streams is small, seldom exceeding a pressure head of 0.2 psi. The pressure drop experienced by the air streams as they pass through the exchanger is normally within the range of 0.01 to 0.1 psi.

The deposition of a thin film upon a porous support by interfacial polymerization is described in some detail by Cadotte (U.S. Pat. Nos. 4,259,183 and 4,277,344), Babcock, et al. (U.S. Pat. No. 4,781,733), Kim, et al. (U.S. Pat. No. 5,593,588). The disclosures of these references are incorporated herein by reference.

First, a porous substrate is saturated with a solution bearing one of the reactants that will react to form the interfacial thin film. In a preferred embodiment, that solution is water containing a water-soluble monomer. The substrate is then transferred to a smooth surface, such as glass or polished steel, where it is rolled or wiped to remove excess liquid. A second solution, immiscible with the first, is then flowed across the top of the substrate. That solution may be an organic solvent containing the second monomer. A polycondensation reaction occurs at the interface between the two solutions almost instantaneously. Due to the formation of a thin polymer layer, usually no more than 0.5 microns, the two solutions are separated from one another and the reaction slows almost to a halt. In this way, the extent of the reaction and the polymer thickness are somewhat self-regulating.

After a period of time from a few seconds to a few minutes, the top solution is poured off or drains away and the substrate is gently rinsed with either water or an organic solvent. The membrane is allowed to dry, and may be heat treated to achieve near-final curing. It may also be mechanically coated with an ultra thin layer of silicon rubber or other compound to seal defects and provide protection.

A small amount of surfactant may be added to the aqueous solution to aid in the wetting of the substrate. An acid scavenger, such as sodium hydroxide or dimethyl piperazine, may be used to promote the reaction.

In an alternative embodiment, the substrate is saturated with the organic solution while the aqueous solution is flowed over the top.

A preferred embodiment of the invention is that comprised of a heat-and-moisture exchanger using a polyamide thin-film composite membrane. While many polymers may be formed using the interfacial polymerization process, a preferred family of interfacial polymers is the polyamides (see, for example, U.S. Pat. Nos. 4,876,009; 5,593,588; 4,277,344; and 4,259,183). These are formed through the combination of a polyfunctional amine with a polyfunctional acyl halide. The polyamides are highly hydrophilic and hence well-suited to the task of transferring water vapor.

Other preferred polymer families include the polyureas, the polysiloxanes, the polyesters, the polycarbonates, the polyurethanes, the polysulfonamides, and copolymers incorporating two or more of the above families or species within the families.

The scope of this invention should not be limited to the interfacial polymers listed here. Rather, the range of polymers represented should provide an indication of the breadth of suitable options.

The porous substrate serves primarily as a mechanical support for the interfacial polymer. It may, however, participate in the mass transfer process as one component of a two component series resistance, with the other component being the resistance of the polymer film. In the preferred embodiment, the substrate should be as porous as possible so as to minimize its mass transfer resistance.

In a preferred embodiment of the current invention, the membrane substrate is made from a fibrous material which may be either woven or non-woven. The non-wovens are particularly cost-effective, and include spun-bonded, flash-spun, melt-blown, and thermally-bonded polypropylene, polyethylene, and polyester.

In another preferred embodiment, the substrate is comprised of a porous film. A number of preferred commercially available porous films are listed in Table 1.

TABLE 1

Some commercially-available porous substrate materials

| Company | Product | Composition | Thickness (microns) |
|---|---|---|---|
| Millipore | MF Membrane | cellulose nitrate/acetate | 150 |
| Millipore | Durapore Hydrophilic | Polyvinylidene fluoride | 125 |
| Millipore | Durapore Hydrophobic | Polyvinylidene fluoride | 125 |
| Hoechst Celanese | Celgard 2500 | Polypropylene | 25.4 |
| Osmonics-Poretics | PETE | Polyester | 6 to 11 |
| Osmonics-Poretics | PTFE | Polytetraflouroethylene | 110 to 150 |
| Osmonics-Poretics | Nylon | Nylon | 110 |
| Osmonics-Poretics | PES | Polyethersulfone | 100 to 120 |
| Osmonics-Poretics | Accurel | Polypropylene | 75 to 150 |
| Sartorius | PA Type 250 | Polyamide | 125 |
| Sartorius | CN Type 113 | Cellulose nitrate | 90 to 140 |
| Sartorius | RC Type 184 | Cellulose | 160 |
| Sartorius | PTFE Type 118 | Polytetrafluoroethylene | 65 to 100 |
| Sartorius | CA Type 111 | Cellulose acetate | 135 |

TABLE 1-continued

Some commercially-available porous substrate materials

| Company | Product | Composition | Thickness (microns) |
|---|---|---|---|
| 3M Company | Microporous Polyethylene | Polyethylene | 45 |

That an interfacial polymer can be reliably and uniformly cast onto a number of the inexpensive films listed here is unprecedented. The direct use of these substrates in interfacial polymerization composite membranes provides cost advantages. Asymmetric and multi-layer porous substrates have exceptional mechanical properties and provide the interfacial polymerization layer with excellent support at the pore-size level.

The scope of this invention should not be limited to the porous substrate materials listed here. Rather, the range of materials represented should provide an indication of the breadth of suitable options.

Experimental

A counterflow mass transfer test cell was used to evaluate the permeability of the thin-film membranes of the present invention to water vapor and certain representative pollutants. The carrier gas in all cases was air. For the surrogate pollutants, propane was selected because it is representative of the paraffinic volatile organic hydrocarbons commonly found in indoor air. Sulfur hexaflouride was chosen because of its status as the tracer gas of choice in most ventilation-related leakage and pollutant-transfer experiments. Carbon dioxide is the ubiquitous byproduct of human activity and at high concentrations reaches contaminant status. Formaldehyde is another common indoor air pollutant outgassed from carpets and building materials.

Water vapor concentrations were determined using calibrated capacitance-type relative humidity sensors. The concentrations of propane, sulfur hexaflouride, carbon dioxide, and formaldehyde were measured using a Miran 1B Infrared Ambient Air Analyzer (Foxboro Company, East Bridgewater, Mass.) with a resolution of 0.1 ppm. Two air streams entered the test cell and passed over the respective faces of the membrane under test. The inlet stream on Side 1 consisted of dry air spiked with one of the species of interest or water vapor, while the inlet on Side 2 received dry air only. Inlet concentrations of the representative pollutants varied between 20 ppm for formaldehyde to 1000 ppm for carbon dioxide. The inlet water vapor relative humidity was approximately 80% for those tests conducted to determine water vapor permeance. The total mass flows on sides 1 and 2 were equal. The cell was operated isothermally at 25° C. and atmospheric pressure.

The methodology for determining the permeance h of the composite membrane in question for any one of the participating gases is readily understood by persons skilled in the art. The collected data in any experiment include the concentrations of the gas of interest at the inlet and exit of both of the airstreams. Also measured are the total mass flows on the two sides of the exchanger. This information in conjunction with the defining equation enables the evaluation of the effectiveness of the mass exchanger for the gas of interest. The mass exchanger operates in counterflow. It is well known that there is a unique relationship between the effectiveness and the NTU for a counterflow mass exchanger. The definition of the NTU is available in any textbook which deals with the art.

From the experimentally determined value of the effectiveness, the value of the NTU can be calculated. The NTU encompasses quantities that have already been determined plus one unknown. That unknown is the overall resistance to mass transfer. With the value of the NTU already determined, the overall resistance follows immediately. The overall resistance to mass transfer is a sum of the convective resistances and the permeance of the membrane. The convective resistances are widely available in the literature since the flow passages are rectangular ducts. The knowledge of the overall resistance and the convective resistances enables calculation of the permeance of the membrane.

In many cases, when only a measure of the water vapor permeance was desired, an alternative apparatus was used. With this two-chamber experiment, the air streams flowing across either side of the membrane under test were maintained at a fixed relative humidities using saturated salt solutions. The rate of water vapor passage through the membrane was obtained gravimetrically from the increase or decrease in the masses of the pans of solution. The air was circulated within the chambers, and the effect of convection was taken into account as before.

As noted earlier, the effectiveness, $\epsilon$, is the standard measure of the performance of a heat or mass transfer device. In the current instance, $\epsilon$ is the fractional amount of a gas or vapor which passes from one air stream to the other within the exchanger. When $\epsilon=0$, no amount of the substance in question passes through the membrane. When $\epsilon=1$, the maximum amount is transferred.

The effectiveness of a mass exchanger is readily calculated from membrane permeability information using standard relationships found in introductory mass transfer texts. For a crossflow exchanger, the effectiveness is given by:

$$\varepsilon = 1 - \exp[(NTU)^{0.22}(\exp\{-(NTU)^{0.78}\} - 1)] \quad \text{Equation 2}$$

where NTU is the number of transfer units for the exchanger, a quantity that depends upon the permeance, h, as follows:

$$NTU = \frac{(h^{-1} + hc^{-1})^{-1} A}{Q} \quad \text{Equation 3}$$

where A is the surface area, Q is the volumetric flowrate, and hc is a convection parameter that depends upon exchanger geometry and air velocity (see Incropera, F. P., D. P. DeWitt. *Introduction to Heat Transfer.* 3rd Ed., Wiley, 1996). In most of the calculations of current interest, the contribution of hc is minor. It should be included when h exceeds 1.0 cm/s, and may then be obtained from standard sources.

When considering a counterflow exchanger, Equation 1 is replaced with Equation 3:

$$\varepsilon = \frac{NTU}{NTU + 1} \quad \text{Equation 4}$$

From thus-obtained values of effectiveness for water vapor and other gases, the device-level selectivities for water vapor with respect to those gases may be calculated using Equation 1.

EXAMPLE 1

The present example illustrates the combined high rate of water vapor transfer and high selectivity against gaseous pollutants that may be obtained using a heat-and-moisture exchanger comprised of thin-film IP composite membrane. The device to be described is particularly cost-effective, due in large part to a novel, low-cost substrate material. The commercially-available material selected was the microporous polypropylene film, XMP 4056, produced by the 3M Company, St. Paul, Minn. The film was approximately 70 microns thick and had stretch-induced pores averaging 0.2 microns across.

The microporous film was saturated with a solution of trimesyol chloride (TMC) in xylene. The concentration of TMC in the xylene was 1.0% by weight. The saturated support material was transferred from the solvent bath to a 25 cm-square glass plate. There it was rolled with a soft rubber roller to remove the excess liquid. Approximately 200 ml of an aqueous solution of phenylene diamine (PDA) was then poured onto the plate. A pool of PDA solution covering the sample was retained on the plate to a depth of approximately 2.5 mm by a 6 mm-deep aluminum frame that was pressed to the glass by clamps. A soft, butyl rubber gasket prevented leakage between the frame and the glass. The concentration of PDA in tap water was 0.2% by weight. A minor amount of surfactant, Iconol NP-9 from BASF Corp., Mount Olive, N.J., was added to facilitate good contact between the two immiscible solutions.

Three minutes were allowed for the condensation reaction to proceed to completion, although a much shorter time would have sufficed. The PDA solution was poured from the glass plate, and the surface of the newly formed composite membrane was rinsed with water. The sample was then peeled away from the glass and hung to dry overnight in room-temperature air. The samples were numbered and loosely stacked in a vented container prior to experimental evaluation.

The gas permeation properties of this composite membrane are given in Table 2.

TABLE 2

Permeation properties of polyamide/polypropylene composite membrane

| Gas or Vapor | Permeance (cm/s) |
|---|---|
| $H_2O$ | 0.43 |
| $C_3H_8$ | 0.0031 |
| $CO_2$ | 0.0040 |
| $SF_6$ | 0.0025 |
| HCHO | 0.0044 |

These permeance values may be readily converted to device-level performance indicators by the mathematical method previously described. The exchanger geometry and operating conditions chosen for this conversion are listed in Table 3, which describes a parallel-plate geometry like that depicted in FIG. 1.

TABLE 3

Exchanger Design Parameters

| | |
|---|---|
| Exchanger Type | Crossflow |
| Membrane Flat-Sheet Dimension | 12 in. × 12 in. |
| Air Velocity in Channels | 500 fpm |
| Corrugation Geometry | 90° triangular |
| Sheet Spacing | 0.08 in. |

The calculated performance of this exchanger is presented in Table 4. Compared to data presented in the scientific literature in connection with existing heat-and-moisture exchangers, the recorded selectivities are exceptional.

TABLE 4

Water Vapor Transfer and Selectivity Performance for a Polyamide/Polypropylene Heat-and-Moisture Exchanger

| Gas or Vapor | Effectiveness | Selectivity |
|---|---|---|
| $H_2O$ | 0.29 | — |
| $C_3H_8$ | 0.0037 | 79 |
| $CO_2$ | 0.0047 | 63 |
| $SF_6$ | 0.0027 | 109 |
| HCHO | 0.0051 | 57 |

EXAMPLE 2

This example illustrates the extraordinarily high rate of water vapor transfer that may be obtained using a parallel-plate exchanger made from thin-film composite membrane. A commercially-available microporous polycarbonate film was chosen for the membrane substrate. The microporous polycarbonate, manufactured using a track-etching process by Osmonics-Poretics Products, Livermore, Calif., was 10 microns thick and had a pore diameter of 0.2 microns. The membrane was fabricated using interfacial polymerization according to Example 1.

The experimentally-determined membrane permeance and calculated exchanger effectiveness are presented in Table 5.

TABLE 5

Moisture transfer performance of a heat-and-moisture exchanger using a polyamide/polycarbonate composite membrane

| Membrane Permeance (cm/s) | Device Effectiveness |
|---|---|
| 1.96 | 0.72 |

The effectiveness was calculated based upon the measured permeance and the exchanger geometry and operating conditions given in Table 6. A counterflow parallel-plate exchanger geometry has been specified.

TABLE 6

Exchanger Design Parameters

| | |
|---|---|
| Exchanger Type | Counterflow |
| Membrane Flat-Sheet Dimension | 24 in. × 24 in. |
| Air Velocity in Channels | 500 fpm |
| Corrugation Geometry | 90° triangular |
| Sheet Spacing | 0.08 in. |

EXAMPLE 3

This example illustrates the high rate of water vapor transfer that may be obtained using a parallel-plate exchanger made from thin-film composite membrane. A commercially-available microporous polyethersulfone material was chosen for the membrane substrate. The microporous polyethersulfone was obtained from Osmonics-Poretics Products, Livermore, Calif., was 112 microns thick and had a pore diameter of 1.2 microns. The membrane was fabricated using interfacial polymerization according to Example 1.

The experimentally-determined membrane permeance and calculated exchanger effectiveness are presented in Table 7.

TABLE 7

| Moisture transfer performance of a heat-and-moisture exchanger using a polyamide/polyethersulfone composite membrane | |
|---|---|
| Membrane Permeance (cm/s) | Device Effectiveness |
| 2.2 | 0.54 |

The effectiveness was calculated based upon the measured permeance and the exchanger geometry and operating conditions given in Table 8.

TABLE 8

| Exchanger Design Parameters | |
|---|---|
| Exchanger Type | Crossflow |
| Membrane Flat-Sheet Dimension | 36 in. × 36 in. |
| Air Velocity in Channels | 500 fpm |
| Corrugation Geometry | 90° triangular |
| Sheet Spacing | 0.16 in. |

EXAMPLE 4

This example illustrates the use of a non-woven, fibrous material as a low-cost IP membrane substrate. A commercially-available, spun-bonded polyolefin with a thickness of 120 microns was chosen for the substrate. The material, Tyvek T980, was obtained from E.I. du Pont de Nemours and Co., Wilmington, Del. The membrane was fabricated using interfacial polymerization according to Example 1, except that the locations of the monomer solutions were reversed. The substrate was first saturated with the aqueous PDA solution and was then contacted with the TMC in xylene.

The experimentally-determined membrane permeance and calculated exchanger effectiveness are presented in Table 9.

TABLE 9

| Moisture transfer performance of a heat-and-moisture exchanger using a polyamide/Tyvek T980 composite membrane | |
|---|---|
| Membrane Permeance (cm/s) | Device Effectiveness |
| 0.90 | 0.38 |

The effectiveness was calculated based upon the measured permeance and the exchanger geometry and operating conditions given in Table 10. This is a large exchanger designed for an industrial application. The Tyvek is particularly well-suited to demanding industrial environments.

TABLE 10

| Exchanger Design Parameters | |
|---|---|
| Exchanger Type | Crossflow |
| Membrane Flat-Sheet Dimension | 48 in. × 48 in. |
| Air Velocity in Channels | 1000 fpm |

TABLE 10-continued

| Exchanger Design Parameters | |
|---|---|
| Corrugation Geometry | sinusoidal |
| Sheet Spacing | 0.24 in. |

EXAMPLE 5

This example illustrates the use of a very low-cost, non-woven, fibrous material as an IP membrane substrate. A commercially-available, spun-bonded polyolefin material with a thickness of 132 microns was chosen for the substrate. The material, Tyvek T16 ("HouseWrap"), was obtained from E.I. du Pont de Nemours and Co., Wilmington, Del. The membrane was fabricated using interfacial polymerization according to Example 1.

The experimentally-determined membrane permeance and calculated exchanger effectiveness are presented in Table 11.

TABLE 11

| Moisture transfer performance of a heat-and-moisture exchanger using a polyamide/Tyvek T16 composite membrane | |
|---|---|
| Membrane Permeance (cm/s) | Device Effectiveness |
| 0.18 | 0.11 |

The effectiveness was calculated based upon the measured permeance and the exchanger geometry and operating conditions given in Table 12.

TABLE 12

| Exchanger Design Parameters | |
|---|---|
| Exchanger Type | Counterflow |
| Membrane Flat-Sheet Dimension | 24 in. × 24 in. |
| Air Velocity in Channels | 100 fpm |
| Corrugation Geometry | 90° triangular |
| Sheet Spacing | 0.08 in. |

EXAMPLE 6

A microporous polyethylene, commercially obtained from the 3M Company, St. Paul, Minn., was used as the substrate for this composite membrane. The membrane was prepared in accordance with Example 1. The experimentally-determined membrane permeance and calculated exchanger effectiveness are presented in Table 13. The effectiveness was calculated based upon the measured permeance and the exchanger geometry and operating conditions given in Table 3.

TABLE 13

| Moisture transfer performance of a heat-and-moisture exchanger using a polyamide/polyethylene composite membrane | |
|---|---|
| Membrane Permeance (cm/s) | Device Effectiveness |
| 0.89 | 0.41 |

EXAMPLE 7

A polyamide/polycarbonate composite membrane was prepared in accordance with Example 1. It was then heat treated in air at 100° C. for one hour to simulate the aging process. During the aging process, the polyamide continues to cure, forming additional bonds and losing the water molecules associated with carboxylic acid groups within the polymer. The membrane was prepared in accordance with Example 1. The experimentally-determined membrane permeance and calculated exchanger effectiveness are presented in Table 14. The effectiveness was calculated based upon the measured permeance and the exchanger geometry and operating conditions given in Table 6.

TABLE 14

| Moisture transfer performance of a heat-and-moisture exchanger using a heat-treated polyamide/polycarbonate composite membrane | |
|---|---|
| Membrane Permeance (cm/s) | Device Effectiveness |
| 1.43 | 0.68 |

Water vapor permeability transfer within the exchanger decreases somewhat as a result of the curing process.

EXAMPLE 8

A non-woven fibrous material formed through the thermal bonding of polyester fibers served as the substrate for this composite membrane. The material, FRT66297, is sold commercially by Freudenberg Nonwovens, Kaiserslautern, Germany. The membrane was prepared in accordance with Example 1, with the addition of sodium hydroxide as a reaction-promoting acid scavenger. Sodium hydroxide was added to the aqueous solution at a concentration equal to that of the PDA. The experimentally-determined membrane permeance and calculated exchanger effectiveness are presented in Table 15. The effectiveness was calculated based upon the measured permeance and the exchanger geometry and operating conditions given in Table 12.

TABLE 15

| Moisture transfer performance of a heat-and-moisture exchanger using a polyamide/polyester composite membrane | |
|---|---|
| Membrane Permeance (cm/s) | Device Effectiveness |
| 0.188 | 0.11 |

EXAMPLE 9–11

A study was conducted to examine the effect of monomer concentrations upon membrane and exchanger performance. Three polyamide/polypropylene membranes were formulated according to the method of Example 1. The ratio of TMC to PDA was varied from 0.3 to 20.

The experimentally-determined membrane permeances and calculated exchanger effectivenesses are presented in Table 16. The effectivenesses were calculated based upon the measured permeances and the exchanger geometry and operating conditions given in Table 3.

TABLE 16

| Comparison of moisture transfer performance of heat-and-moisture exchangers made from polyamide/polycarbonate membranes using three different reactant ratios | | | |
|---|---|---|---|
| Amine Concentration (weight %) | Acid Chloride Concentration (weight %) | Membrane Permeance (cm/s) | Device Effectiveness |
| 0.80 | 0.25 | 0.41 | 0.28 |
| 0.40 | 0.50 | 0.41 | 0.28 |
| 0.20 | 1.0 | 0.42 | 0.28 |
| 0.10 | 2.0 | 0.38 | 0.27 |

The moisture transfer performance of this particular device is insensitive to monomer concentration.

EXAMPLE 12–14

Three different polyamide chemistries were compared. The identity of the amine was varied so that IP composite membranes were deposited upon the microporous polycarbonate substrate of Example 2 using xylylene diamine (XDA), phenylene diamine (PDA), and piperazine (PPZ).

All three composite membranes were prepared according to the method of Example 1. The concentration of the TMC in xylene was 2.0% by weight, while the concentration of the amine component was 0.1% by weight in water. Dimethyl piperazine was used as an acid scavenger at a concentration of 0.2% by weight.

The experimentally-determined membrane permeances and calculated exchanger effectivenesses are presented in Table 17. The effectivenesses were calculated based upon the measured permeances and the exchanger geometry and operating conditions given in Table 8.

TABLE 17

| Comparison of moisture transfer performance of heat-and-moisture exchangers using three different polyamide/polycarbonate composite membranes | | |
|---|---|---|
| Amine Monomer | Membrane Permeance (cm/s) | Device Effectiveness |
| XDA | 0.91 | 0.45 |
| PDA | 1.29 | 0.49 |
| PPZ | 1.55 | 0.51 |

A rationale for the observed trend in performance centers upon the tradeoff between the hydrophobic and hydrophilic qualities of the amine monomer. Any nitrogen-hydrogen bonds which are present can be broken to allow reaction with the carboxylic acid monomer (TMC) during polymerization, creating a hydrophilic carbon-oxygen-nitrogen group. Any carbon-carbon or carbon-nitrogen bonds that are present cannot react in this way, and instead serve to enhance the hydrophobic character of the polymer. A qualitative measure of the hydrophilic potential of the amine may thus be obtained by taking the ratio of the number of nitrogen atoms to the number of carbon atoms. The N:C ratio increases along with the water vapor permeance. All three polymers are excellent transmitters of water vapor.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An air-to-air heat and moisture exchange comprising:

(a) a plurality of membrane sheets which are suitable for operating in an air environment, and which preferentially allow water or water vapor to cross therethrough in response to a moisture gradient from a first side of each of said membrane sheets to a second side of each of said membrane sheets, said membrane sheets including a porous substrate and a hydrophilic polymeric material deposited upon said porous substrate and forming a layer thereon, said hydrophilic polymeric material formed in place by interfacial polymerization;

(b) a support structure for holding each of said plurality of membrane sheets in generally parallel spaced relation to form a plurality of flow areas, one between each adjacent pair of said membrane sheets; and, (c) means for passing a first air stream and a second air stream through alternating flow areas so that said first air stream and said second air stream are on opposite sides of each of said membrane sheets to allow heat and moisture transfer therebetween.

2. The air-to-air heat and moisture exchanger of claim 1, wherein said hydrophilic polymeric material is generally insoluble in water.

3. The air-to-air heat and moisture exchanger of claim 1, wherein said hydrophilic polymeric material is the condensation reaction product of a polyfunctional amine with a polyfunctional acyl halide.

4. The air-to-air heat and moisture exchanger of claim 1, further comprising a defect sealing coat of polymeric material overlying said hydrophilic polymeric material on said porous substrate.

5. The air-to-air heat and moisture exchanger of claim 1, wherein the hydrophilic polymeric material is selected from the group consisting of: polyamides, polyureas, polysiloxanes, polyesters, polycarbonates, polyurethanes, polysulfonamides, and copolymers thereof.

6. The air-to-air heat and moisture exchanger of claim 1, wherein said porous substrate is manufactured from a polymeric material.

7. The air-to-air heat and moisture exchanger of claim 6, wherein said polymeric material is selected from the group consisting of: cellulose nitrate/acetate, polyvinylidene fluoride, polypropylene, polyester, polytetrafluoroethylene, nylon, polyethersulfone, polyamide, cellulose and polyethylene.

8. An air-to-air heat and moisture exchanger operating at near-atmospheric pressure comprising:

(a) a plurality of membrane sheets suitable for operating in an air environment, each comprised of a porous substrate and a hydrophilic polymeric material deposited upon said porous substrate by interfacial polymenzation, forming a composite membrane sheet which is highly transmitting of water or water vapor due in part to the porosity of said porous substrate, and in other part to the hydrophilic character of the polymeric material, and which is less transmitting of other gases, particularly those regarded as pollutants in indoor air, due to the bridging and sealing-off of the pores of said porous substrate by said hydrophilic polymeric material, said hydrophilic polymeric material possessing a selectivity characterized by the preferntial transport of water over other substances;

(b) a support structure for holding each of said plurality of membrane sheets in generally parallel spaced relation to form a plurality of flow areas, one between each adjacent pair of said membrane sheets; and, (c) means for passing a first air stream and a second air stream through alternaring flow areas so that said first air stream and said second air stream are on opposite sides of each of said membrane sheets to allow heat and moisture transfer therebetween.

9. The air-to-air heat and moisture exchanger of claim 8, wherein said hydrophilic polymeric material is generally insoluble in water.

10. The air-to-air heat and moisture exchanger of claim 8, wherein said hydrophilic polymeric material is the condensation reaction product of a polyfunctional amine with a polyfunctional acyl halide.

11. The air-to-air heat and moisture exchanger of claim 8, further comprising a defect sealing coat of polymeric material overlying said hydrophilic polymeric material on said substrate.

12. The air-to-air heat and moisture exchanger of claim 8, wherein the hydrophilic polymeric material is selected from the group consisting of: polyamides, polyureas, polysiloxanes, polyesters, polycarbonates, polyurethanes, polysulfonamides, and copolymers thereof.

13. The air-to-air heat and moisture exchanger of claim 8, wherein said porous substrate is manufactured from a polymeric material.

14. The air-to-air heat and moisture exchanger of claim 13, wherein said polymeric material is selected from the group consisting of: cellulose nitrate/acetate, polyvinylidene fluoride, polypropylene, polyester, polytetrafluoroethylene, nylon, polyethersulfone, polyamide, cellulose and polyethylene.

15. An air-to-air beat and moisture exchanger comprising:

(a) a plurality of membrane sheets suitable for operating in an air environment, said membrane sheets including a polymeric porous material and a hydrophilic polymeric material deposited on said porous substrate and forming a layer thereon, said hydrophilic polymeric material formed in place by interfacial polymerization as the condensation reaction product of a polyfunctional amine with a polyfunctional acyl halide;

(b) a support structure for holding each of said plurality of membrane sheets in generally parallel spaced relation to form a plurality of flow areas, one between each adjacent pair of said membrane sheets; and, (c) means for passing a first air stream and a second air stream through alternating flow areas so that said first air stream and second said air stream are on opposite sides of each of said membrane sheets to allow heat and moisture transfer therebetween.

16. The air-to-air heat and moisture exchanger of claim 15, wherein said porous substrate is manufactured from a non-woven polymeric material.

17. The air-to-air heat and moisture exchanger of claim 15, wherein said polymeric material is selected from the group consisting of: cellulose nitrate/acetate, polyvinylidene fluoride, polypropylene, polyester, polytetrafluoroethylene, nylon, polyethersulfone, polyamide, cellulose and polyethylene.

18. The air-to-air heat and moisture exchanger of claim 15, further comprising a defect sealing coat of polymeric material overlying said hydrophilic polymeric material on said substrate.

* * * * *

UNITED STATES PATENT AND TRADEMARK OFFICE

CERTIFICATE OF CORRECTION

PATENT NO. : 6,145,588
DATED : November 14, 2000
INVENTOR(S) : Gerald Martin et al.

It is certified that error appears in the above-identified patent and that said Letters Patent is hereby corrected as shown below:

In the title please delete "Technical Field".

In column 16, claim 15, line 47, please delete "beat" and insert --heat--.

Signed and Sealed this

Eighth Day of May, 2001

*Attest:*

Nicholas P. Godici

NICHOLAS P. GODICI

*Attesting Officer*

*Acting Director of the United States Patent and Trademark Office*